United States Patent [19]

Huber et al.

[11] 4,454,881

[45] Jun. 19, 1984

[54] MULTI-LAYER FACE MASK WITH MOLDED EDGE BEAD

[75] Inventors: Otto L. Huber, Beverly Hills; Mark Magidson, Los Angeles, both of Calif.

[73] Assignee: Moldex/Metric Products, Inc., Culver City, Calif.

[21] Appl. No.: 294,834

[22] Filed: Aug. 21, 1981

[51] Int. Cl.[3] ..... A62B 7/10

[52] U.S. Cl. ..... 128/206.15; 128/206.16; 128/206.19; 128/206.24; 128/207.11; 128/207.12

[58] Field of Search ..... 128/205.25, 206.12, 128/206.13, 206.17, 206.16, 206.22, 206.26, 206.28, 207.11, 207.12, 206.24

[56] References Cited

U.S. PATENT DOCUMENTS

| | | | |
|---|---|---|---|
| 577,681 | 2/1897 | Dunlap | 128/206.26 |
| 2,166,164 | 7/1939 | Lehmberg | 128/206.24 |
| 2,922,417 | 1/1960 | Bradley et al. | 128/206.12 |
| 2,922,418 | 1/1960 | Heffernan et al. | 128/207.11 |
| 2,931,356 | 4/1960 | Schwarz | 128/206.24 |
| 3,521,630 | 7/1970 | Westberg et al. | 128/206.24 |
| 3,750,665 | 8/1973 | Stranicky | 128/206.26 |
| 3,861,381 | 1/1975 | Witman et al. | 128/206.12 |
| 4,319,567 | 3/1982 | Magidson | 128/206.24 |
| 4,384,577 | 5/1983 | Huber et al. | 128/206.24 |

FOREIGN PATENT DOCUMENTS

| | | | |
|---|---|---|---|
| 37712 | 10/1935 | Netherlands | 128/206.24 |
| 2028664 | 3/1980 | United Kingdom | 128/206.19 |

*Primary Examiner*—Henry J. Recla
*Assistant Examiner*—Karin M. Reichle
*Attorney, Agent, or Firm*—Charles H. Schwartz; Ellsworth R. Roston

[57] ABSTRACT

A face mask to be worn upon the face of a wearer and for providing filtering of particular impurities in the air, including at least one layer of flexible material molded generally to conform to the contours of the face of the wearer and forming a flexible support carrier for filter material and with the one layer of flexible material allowing the passage of air through the one layer, a separate layer of filter material supported by the one layer of flexible material and with the filter material filtering out the particular impurities in the air, a molded, rubber-like bead member extending around the peripheral edge of the layers forming the face mask and with the molded rubber-like bead member providing an edge seal between the face mask and the face of the wearer, and the bead member including membrane portions extending inwardly to the interior of the mask from the bead member at least in the areas of the sides of the nose and upper cheekbones of the wearer for providing additional sealing in those areas.

9 Claims, 15 Drawing Figures

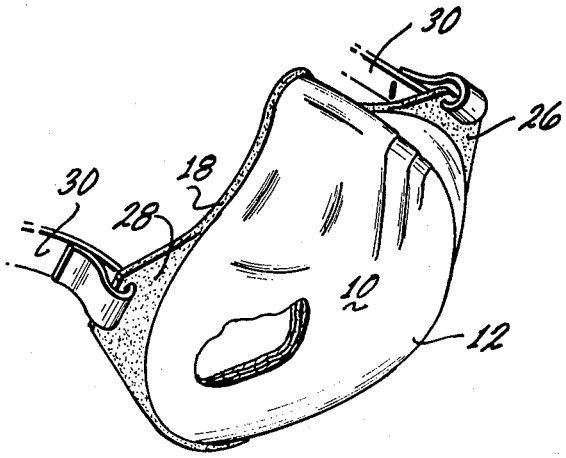
FIG. 1
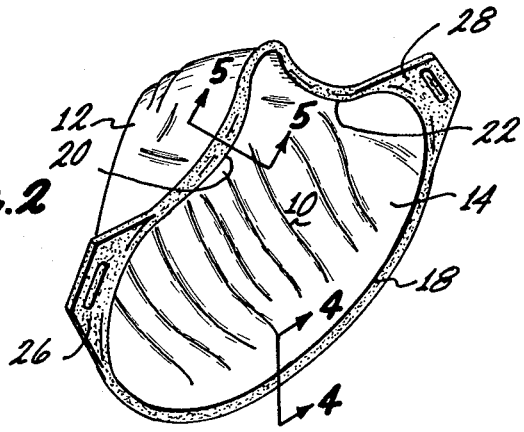
FIG. 2
FIG. 3
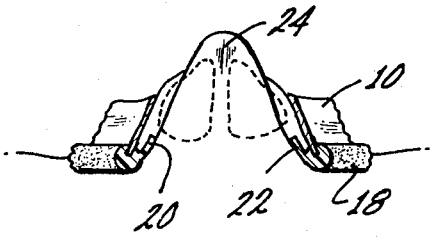
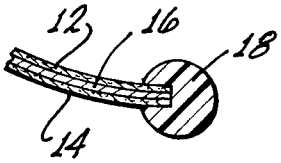
FIG. 4
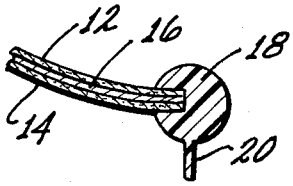
FIG. 5
FIG. 6
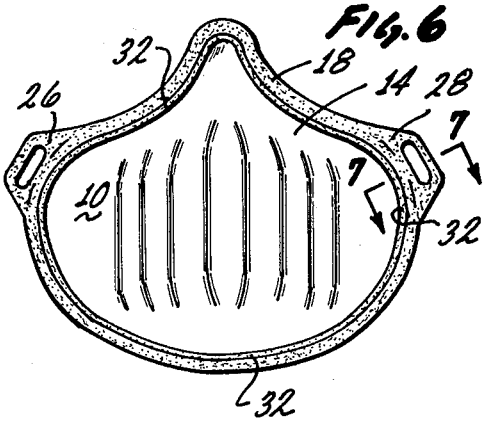

FIG. 7
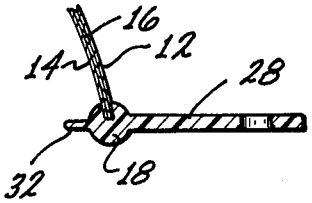
FIG. 8
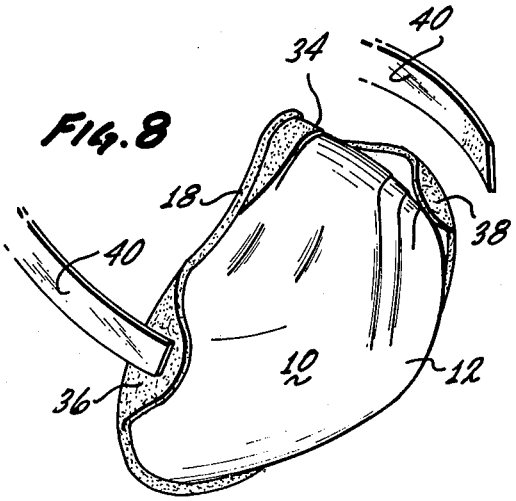
FIG. 9
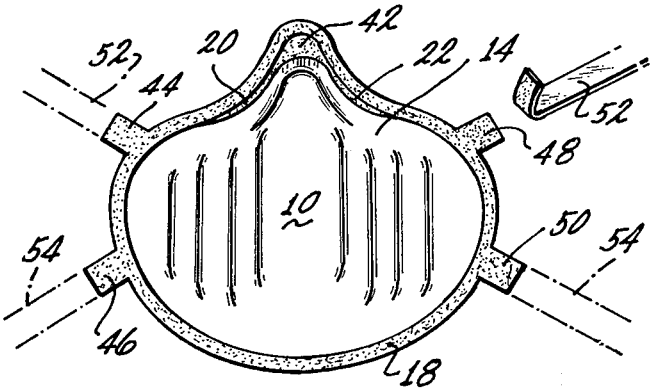
FIG. 10
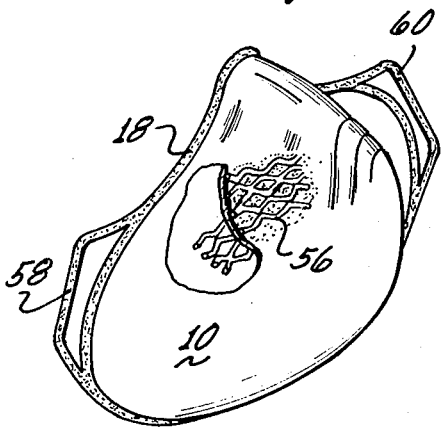
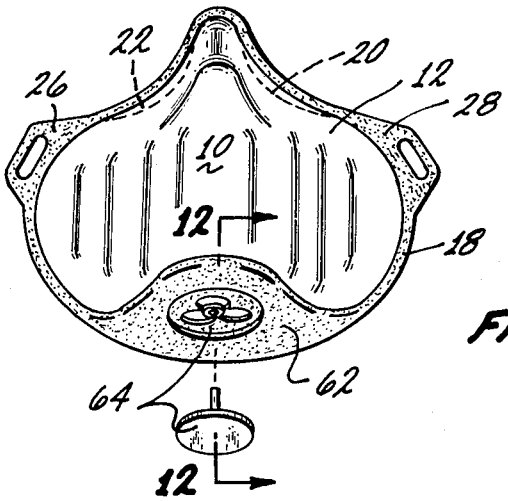
FIG. 11

MULTI-LAYER FACE MASK WITH MOLDED EDGE BEAD

BACKGROUND OF THE INVENTION

1. Field of the Invention

The present invention relates to face masks, and, in particular, face masks formed from a plurality of layers and with the individual layers serving different functions and with a molded bead extending around the edge of the face mask.

2. Description of the Prior Art

In the prior art, face masks have been constructed using a pair of flexible layers of fiberfill material and with a layer of filter material supported between the layers of fiberfill material. In the prior art face masks, an edge portion of the face mask is heat sealed to form a line seal extending around the periphery of the mask and with this periphery line seal stiffening and sealing the edge portion of the face mask. In order to provide for the face mask of the prior art being sealed against the face of the wearer, a pair of elastic bands are attached to the face mask. The elastic bands extend around the head of the wearer so that the mask is pulled tightly against the face. The prior art face masks also use a separate piece of foam rubber which is attached to the inner surface of the face mask and extend across the nose bridge portion of the mask. The piece of foam rubber provides for additional sealing of the mask in the nose bridge area. In addition, the prior art face masks include a metal clip on the outside of the mask across the nose bridge portion, so that the wearer of the mask can bend the metal clip to maintain the foam rubber in sealing contact.

Generally, the masks of the prior art are uncomfortable to wear, since the mask is maintained very tightly against the face by the double bands and with the metal clip also squeezing the mask against the face in the nose bridge area. It will be appreciated that if the mask is uncomfortable to wear, there are times when workers will not wear the mask even though the use of a filter mask is indicated because of environmental conditions.

In addition, the prior art masks do not maintain as tight an edge seal during facial movement such as during speech or change or facial expression. Also, the use of the metal clip, once set in position, may allow for the entire nose bridge portion lifting off during facial movement.

SUMMARY OF THE INVENTION

The present invention is directed to a multi-layer face mask which is comfortable to wear and which seals to the face of the wearer without the necessity of tight elastic bands or metal clip members. Reference is made to co-pending application Ser. No. 157,522 listing Martin R. Skov, which application is assigned to a related company of the assignee of the present application, for an earlier filed application showing a multi-layer face mask wherein at least one layer is formed out of an open-work, flexible plastic material so as to serve as a support layer for carrying at least another layer of filter material. In this co-pending application, one embodiment of the invention discloses the use of a peripheral edge portion of the face mask sealed by an attached, molded gasket member and, with this gasket member, providing for a sealing of the mask against the face of the wearer.

The present invention is directed to an improved multi-layer face mask using an injection-molded bead around the periphery of the mask to support, stiffen and give shape to the face mask and with the molded bead having a particular configuration for providing for additional sealing, especially around the nose and upper cheek area of the face mask. Specifically, in the present invention, the molded bead includes membrane portions extending inwardly at least in the nose and upper cheek area of the mask. The membrane portions are thin, flexible and lie against the sides of the nose and the cheekbones of the wearer and thereby provide additional sealing in these critical areas. There is a tendency for air to leak around the nose and cheekbones since these are the hardest areas to seal for various facial contours. The membrane portions therefore extend inwardly to lie against the side of the nose and the cheekbones and since the membrane portions are thin and flexible, they adapt to the various facial contours even during facial movement such as during speech or change of facial expression.

As indicated above, the molded bead, with the membrane portions, may extend along the nose and upper cheek areas, but the membrane portion may also extend around additional areas of the mask to provide for additional sealing around the periphery of the mask. In addition, since the molded bead is formed by an injection molding technique, the present invention provides for molding additional integral portions of the molded bead to extend further on the inside or outside of the mask to provide for additional functions. For example, portions of the bead may be molded to extend either on the inside or the outside surface around the nose area to provide for additional support in this area. The bead may be molded to extend into the inside or outside surface of the mask along the sides of the mask so as to provide for side supports for strap members to hold the mask against the face. The bead may be molded to extend on the inside or outside surface of the mask at a bottom portion to allow for the insertion of an exhalation valve.

With the face mask of the present invention, the pair of layers of fiberfill material provide for a flexible shape-retaining carrier support for the filter material. The fiberfill layers allow for the generally unrestricted passage of air, which air is filtered by the intermediate filter layer. The layer of filter material may be of any of the general types of filter material commonly used in face masks for providing for the filtering of particular impurities in the air. Some of the filter materials currently used are not shape-retaining or self-supporting, so it is necessary to use some sort of carrier means, such as the fiberfill layers, to provide for the support of the filter material. It is to be appreciated, however, that in place of the fiberfill layers an open-work layer of plastic material, such as shown in the previously referred to co-pending application, may be used.

The filter material may be formed from various types of filter material such as electrostatically-charged woven or non-wover polyester or polypropylene fibers, fiberglass, activated charcoal sheets or particles, various types of natural fibers such as wool and other types of filter materials commonly used. Many of the filter materials commonly used to provide the filter layer of the face mask cannot stand high heat since the heat may reduce or eliminate the filtering properties of the material. With the present invention, the fiberfill layers or the openwork plastic may be previously formed or may be formed using the method which does not subject the filter material to high heat, as disclosed in the previously referred to co-pending application. In addition, the injection molding of the bead around the periphery of the face mask does not provide for any appreciable heat to the filter material since the injection molding is substantially confined to the peripherial portions of the mask. The molded bead may be formed either from rubber or a synthetic rubber such as "Kraton", a product of Shell, or may be formed from other rubber-like materials such as rubberized vinyl or other thermoplastic rubber-like materials.

BRIEF DESCRIPTION OF INVENTION

FIG. 1 is a front perspective view of a first embodiment of a face mask constructed in accordance with the teachings of the present invention.

FIG. 2 is a back perspective view of the face mask of FIG. 1.

FIG. 3 is a detail of the face mask of FIG. 1 showing the bead member including the membrane portion lying against the side of the nose of the wearer for sealing the face mask.

FIG. 4 is a cross-sectional view of the bead portion of the first embodiment of the face mask taken along lines 4—4 FIG. 2.

FIG. 5 is a cross-section of the bead portion of the first embodiment of the face mask taken along lines 5—5 of FIG. 2.

FIG. 6 is a back view of an alternate structure for the first embodiment of the invention, including membrane portions extending around the periphery of the maks.

FIG. 7 is a cross-sectional of the face mask of FIG. 6 taken along lines 7—7 of FIG. 6.

FIG. 8 is a front perspective view of a second embodiment of the invention including the bead molded over the nose bridge on the outside surface for additonal support and also extending into the sides of the mask for receiving an elastic band and for providing a flat portion for supporting the nose piece portions of eye glasses.

FIG. 9 is a back view of a third embodiment of the present invention including the molded bead extending over the nose bridge on the inside surface and extending out along side portions to receive straps members.

FIG. 10 is a front perspective view of a fourth embodiment of the invention wherein at least one of the support layers is formed of open-work plastic.

FIG. 11 is a front view of a fifth embodiment of the invention including the molded bead extended along a bottom portion of the mask to receive an exhalation valve.

Figure 12:
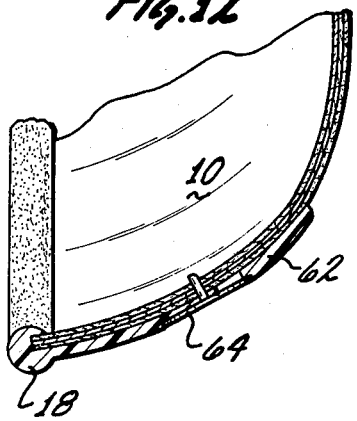
FIG. 12 is a cross-sectional view of the fifth embodiment of the invention taken along lines 12—12 of FIG. 11.

FIGS. 1 through 5 show a first embodiment of a face mask 10 of the present invention, which face mask is formed from three layers of material. Specifically, the face mask 10 includes an outer flexible layer 12 which may be formed as a fiberfill shell. The outer shell 12 may be molded using non-woven polyester fibers and the shell serves as an outer support layer and pre-filter. An inner flexible layer 14 may also be formed as a fiberfill shell and may also be molded using non-woven polyester fibers. The layers 12 and 14 may not have the exact characteristics, and, as an example, the outer layer 12 may be formed of larger fibers than the inner layer 14 so that the inner layer, by being formed of finer fibers, may have a softer and therefore more comfortable surface to lie against the face of the wearer.

The inner and outer layers 12 and 14 are used to sandwich a middle layer 16 of filter material. This filter material may be formed of any known type of filter material so as to provide for filtering of particular elements in the air. For example, the following type of filter material has been used to provide for filtering but it is to be appreciated that other filter material may be used; activated charcoal-treated sheets or sheets formed from charcoal particles, fiberglass material, electrostatic material such as made from fine denier non-woven polyethelene or polypropylene fibers, natural materials such as wool. The present invention contemplates using any of these known types of filtering material for the center layer 16 sandwiched and supported by the outer layers 12 and 14.

The present invention also incorporates an injection molding bead 18 of rubber-like material extending around and sealing the peripheral edge of the face mask 10. Specifically, as shown in FIGS. 3, 4 and 5, the three layers 12, 14 and 16 extend into the center of the bead 18 since the bead 18 is molded around the edge portion of the layers. The bead member 18 may be formed from either natural or synthetic rubber. As an example, material such as rubberized vinyl or thermoplastic rubber-like material may be used. A particular preferred material is a synthetic rubber-like material manufactured by Shell and sold under the trademark "Kraton".

The bead 18 is molded to included integral membrane portions 20 and 22 which membrane portions extend inwardly in the nose bridge and cheekbone areas of the mask 10. The membrane portions 20 and 22 are formed at an angle relative to the three layers 12, 14 and 16. This may be clearly seen with reference to FIG. 5. The membrane portions 20 and 22 are thin and relatively soft and thereby bend easily. The membrane portions therefore provide for a flexible surface to conform to the facial contours of the wearer and thereby produce an additional sealing of the mask against the face of the wearer along the sides of the nose and the upper cheekbone portions. This can be more clearly seen in FIG. 3 where a partially broken-away view is shown looking down on the mask in the nose bridge area. As can be seen, the membrane portions 20 and 22 lie against the sides of the nose 24 and also lie against the upper cheekbones of the wearer of the mask. The bead 18 itself provides for sealing of the mask against the face of the wearer and the membrane portions 20 and 22 provide for additional sealing in the critical area along the sides of the nose and along the upper cheekbones and accomodates facial contours of varying characteristics.

The bead 18 of the first embodiment of the face mask shown in FIGS. 1 through 5 also includes integrally molded ear portions 26 and 28. The portions 26 and 28 include openings to receive a strap member 30 as shown in FIG. 1. The ear portions 26 and 28 are injection molded when the bead 18 is injection molded and therefore form outward extensions of the bead 18.

FIGS. 6 and 7 show an alternative structure for the first embodiment of the invention. FIG. 6 is a view of the back or the inside of the face mask 10 and, as can be seen in FIG. 6, the bead 18 includes a membrane portion 32 extending completely around the inner surface of the face mask. FIG. 7 shows the membrane portion 32 and the ear portion 28 both forming intergral extentions of the bead 18. The membrane 32 therefore provides for the additional membrane sealing, not only in the nose bridge area but also extending completely around the periphery of the face mask.

FIG. 8 illustrates a further embodiment of the invention including additional integral molded portions to provide for additional support in the nose bridge area and also along the side areas for receiving strap members. In FIG. 8 the face mask 10 includes the same structure of a pair of layers 12 and 14 of support materials and with an intermediate layer of filter material 16 sandwiched therebetween as shown in FIG. 1. However, in the embodiment of FIG. 8, the molded bead 18 extending around the periphery of the mask 10 includes an integral molded area 34 which extends over the nose bridge portion of the mask so as to provide for an additional resiliant support for the nose bridge portion of the mask. In particular, the area 34 may be molded so that the nose bridge portion has a relatively narrow configuration which would become spread apart as the mask is placed on the face of the wearer. The area 34 therefore acts as a resilient, springy support surface to tend to maintain the nose bridge portion of the molded bead 18 with the membrane portion in contact with the face of the wearer. In addition, the area 34 may form flat pad portions as shown on each side of the nose to receive and support nose piece portions of eye glasses to prevent the glasses from sliding forward.

FIG. 8 also has the bead 18 including portions 36 and 38 which extend over side areas of the outer support layer 12. The portions 36 and 38 are intergrally molded with the bead 18 and are designed to receive a strap member 40. The strap member 40 may be either adhesively fixed or heatbonded to the portions 36 and 38 so that the portions serve as pads to receive the ends of the strap member 40.

FIG. 9 illustrates a back or inside view of another embodiment of the face mask 10 including the pair of support layers with an intermediate filter layer. As shown in FIG. 9, the molded bead 18 includes an integrally molded portion 42 which extends over the surface of the inner layer 14 and which provides for an additional resilient support in the nose bridge area of the mask 10. This is similar to the molded support portion 34 shown in FIG. 8 except, in the embodiment of FIG. 8, the molded support portion is on the exterior of the mask and in the embodiment of FIG. 9 the molded support portion is on the interior of the mask.

The embodiment of FIG. 9 also includes tab portions 44 through 50 extending outwardly and where the portions are integrally molded with the bead 18. The tab portions are used to support elastic bands 52 and 54 which bands hold the mask to the face of the wearer. The ends of the elastic bands 52 and 54 may be attached to the tab portions either using an adhesive or by heat welding.

FIG. 10 illustrates another embodiment of the face mask 10 wherein at least one of the inner or outer support layers is formed from open-work plastic as shown by open-work plastic 56. This open-work plastic would be similar to that shown in co-pending application Ser. No. 157,552 referred to earlier. The face mask 10 of FIG. 10 includes the integrally molded bead portion 18 extending around the periphery of the mask and would also include either the membrane portions 20 and 22 as shown in FIGS. 2 and 5 or a membrane portion 32 as shown in FIGS. 6 and 7, so as to provide for the additional sealing of the mask against the face of the wearer.

The embodiment of FIG. 10 may also include arm members 58 and 60, which are integrally molded with the bead 18 and with the arm members extending away from the bead member 18 so as to receive a strap member.

FIG. 11 shows a front view of yet another embodiment of the face mask 10 of the present invention. The embodiment of FIG. 11 is similar to the embodiment of FIGS. 1 through 5, except the embodiment of FIG. 11 includes an integrally molded portion 62, extending from the bead member 18 and over the outer surface of the outer support layer 12. This may also be seen in the crosssectional view of FIG. 12. The use of the additional support surface 62 allows for sufficient support to include an exhalation valve 64 to be incorporated in the embodiment of the face mask shown in FIGS. 11 and 12. The exhalation valve 64 allows for a freer passage of air exhaled by the wearer of the mask.

Figure 13:
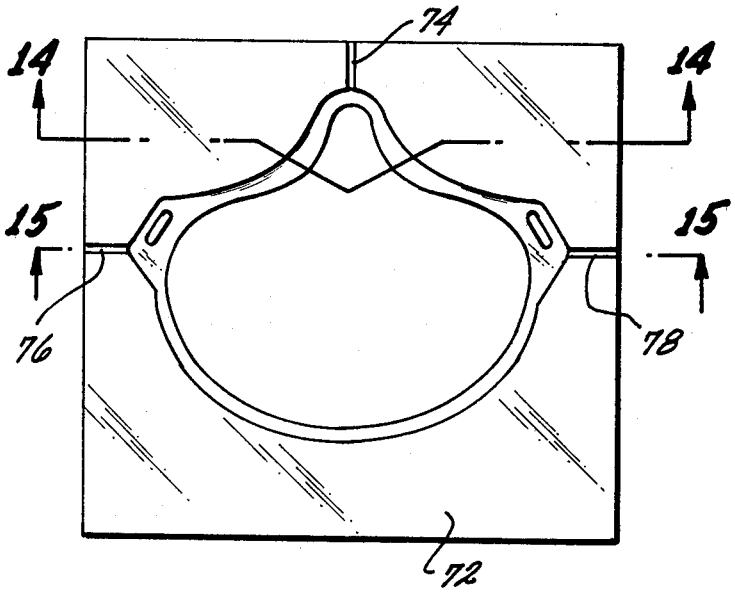
FIG. 13 illustrates a mold structure used in a method of producing the present invention for injection molding the bead around the periphery of the mask.
Figure 14:
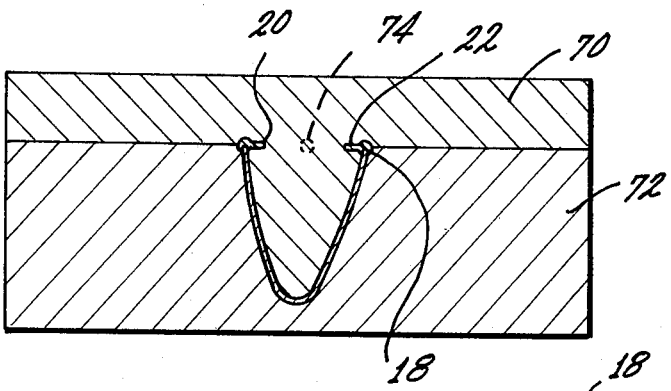
FIG. 14 is a cross-sectional view of the mold structure of FIG. 13 taken along lines 14—14 of FIG. 13.
Figure 15:
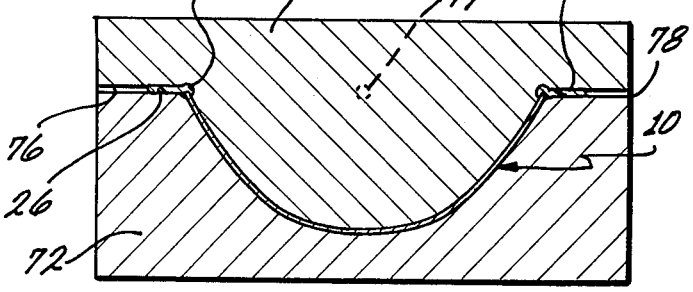
FIG. 15 is a cross-sectional view of the mold structure taken along lines 15—15 of FIG. 13.

FIGS. 13, 14 and 15 illustrate structure for providing for the molding of any of the embodiments of the face mask 10 of the present invention. In particular, FIGS. 13, 14 and 15 illustrate the molding of the first embodiment of the face mask 10 shown in FIGS. 1 through 5. As can be seen in FIGS. 13, 14 and 15, a top and bottom mold members 70 and 72 include surfaces conforming to the desired shape of the face mask 10. The inner and outer support layers 12 and 14 and the filter material 16 may be precut to the desired configuration and then formed in the mold members 70 and 72. Alternatively, the three layers 12, 14 and 16 may be preformed to the desired configuration and then placed between the mold members 70 and 72. In either case, the edge portion of the layers forming the mask 10 is positioned within the opening between the mold member so as to receive the integrally molded bead member 18 which is injection-molded around the edge of the mask through ports 74, 76 and 78.

As can be seen in FIGS. 13 through 15, the opening between the mold members 70 and 72 have a configuration so as to form the bead 18 and to also integrally form the membrane portions 20 and 22 as shown in FIG. 14 and the flange portions 26 and 28 as shown in FIG. 15. The mask 10 formed by the mold members 70 and 72, therefore, includes the layers of support material and the intermediate filter layer and additionally include the injection molded bead 18 extending around the periphery of the mask and with the additionally integrally molded membrane portions 20 and 22. It will be appreciated that, in place of the membrane portions 20 and 22, a continuous membrane portion 32 may extend completely around the interior of the mask. Also, the mold members 70 and 72 may have an integral configuration to provide for any of the additional molded surfaces such as pad portions 34, 36, 38, 42 and 62 or any of the extending tab portions 44 through 50 and 58 and 60.

The actual molding of the bead 18 and all of the other integrally molded portions is through the molding ports 74, 76 and 78 and, in order to provide for the proper flow of the molding material, the molding as indicated above, may be accomplished using an injection-molding technique. The injection molding provides for sufficient force for the rubber-like material to flow completely through the openings formed between the mold members 70 and 72 and also mold around and seal the edge portion of the mask 10.

It will be appreciated that in addition to the particular embodiments of the invention shown, other adaptations and modifications may be made and the invention is only to be limited by the appended claims.

We claim:

1. A face mask to be worn upon the face of a wearer and for providing filtering of particular impurities in the air, including at least one layer of flexible material molded generally to conform to the contours of the face of the wearer including the areas of the sides of the nose, the bridge of the nose and upper cheekbones and forming a flexible support carrier for filter material and with the at least one layer of flexible material allowing the passage of air through the one layer, a separate layer of filter material supported by the at least one layer of flexible material and with the filter material filtering out the particular impurities in the air, a molded, rubber-like bead member molded to and extending around the peripheral edges of the at least one layer of flexible material and the separate layer of filter material forming the face mask and with the molded rubber-like bead member providing an edge seal between the face mask and the face of the wearer, and the bead member including membrane portions extending inwardly to the interior of the mask from the bead member and with the membrane portion at least in the areas of the sides of the nose and upper cheekbones of the wearer for providing additional sealing in those areas, an exhalation port extending through the layers adjacent the peripheral edges thereof, the bead member including an integrally molded portion extending over and molded to the at least one layer of flexible material and over said exhalation port, said integrally molded portion defining an integrally molded exhalation valve seat adapted to cooperate with an exhalation value member.

2. The face mask of claim 1 additionally including another layer of flexible material forming another flexible support carrier for the filter material and with the layer of filter material sandwiched between the layers of flexible material.

3. The face mask of claim 1 wherein the bead member additionally includes an integrally molded portion extending over and molded to the at least one layer of flexible material in the nose bridge area of the face mask to form an additional supporting surface in the nose bridge area.

4. The face mask of claim 1 wherein that at least one layer of flexible material is composed of non-woven fibers formed as a fiberfill shell.

5. The face mask of claim 1 wherein the at least one layer of flexible material is formed of openwork flexible plastic material.

6. The face mask of claim 1 wherein the membrane portions of the bead member extend completely around the periphery of the face mask.

7. The face mask of claim 1 additionally including a strap member and wherein the bead member includes integrally molded portions for receiving and supporting the ends of the strap member.

8. The face mask of claim 1 wherein the integrally molded portions for receiving and supporting the ends of the strap member extend outward from the bead member at the sides of the face mask.

9. The face mask of claim 1 wherein the integrally molded portions for receiving and supporting the ends of the strap member extend over and are molded to the at least one layer of flexible material along the sides of the face mask.

* * * * *